US006447275B1

(12) United States Patent
Johansson

(10) Patent No.: US 6,447,275 B1
(45) Date of Patent: Sep. 10, 2002

(54) SCREW PUMP

(76) Inventor: Anders Johansson, Hasselgaten 10, 421 77 Västra Frölunda (SE)

( * ) Notice: Subject to any disclaimer, the term of this patent is extended or adjusted under 35 U.S.C. 154(b) by 0 days.

(21) Appl. No.: 09/743,660

(22) PCT Filed: Jul. 8, 1999

(86) PCT No.: PCT/SE99/01244

§ 371 (c)(1),
(2), (4) Date: Mar. 2, 2001

(87) PCT Pub. No.: WO00/05503

PCT Pub. Date: Feb. 3, 2000

(30) Foreign Application Priority Data

Jul. 13, 1998 (SE) ..... 9802516

(51) Int. Cl.[7] ..... F03C 2/00
(52) U.S. Cl. ..... 418/195; 418/204
(58) Field of Search ..... 418/195, 204

(56) References Cited

U.S. PATENT DOCUMENTS 2,413,209 A * 5/1946 Bejeuhr ..... 418/195
3,726,616 A * 4/1973 Powers ..... 418/195
5,395,225 A 3/1995 Johansson

FOREIGN PATENT DOCUMENTS

WO WO 82/03428 * 10/1982 ..... 418/195

* cited by examiner

*Primary Examiner*—Thomas Denion
*Assistant Examiner*—Theresa Trieu
(74) *Attorney, Agent, or Firm*—Klarquist Sparkman, LLP

(57) ABSTRACT

A screw pump includes a screw rotatably arranged in a housing, the threads of which are partially in engagement with a rotatable sealing device having radial sealing discs, whereby the screw area of the screw, including thread grooves and thread walls, are formed by a generatrix which is a part of a circle arc, the circle of which is rotatable around an eccentric rotation axis when the generatrix rotates around the axis of the screw and is displaced along this with a velocity being proportional to the rotational velocity of the screw. The sealing device includes at least one circular disc, the eccentric rotational axis of which, which is arranged transverse to the axis of the screw coincides with the rotation axis of the generatrix i.e., the rotation axis of the disc is a tangent to the generatrix, whereby the screw is mounted in one end and has a radially, partially extending broad flange without any rise in a cross section immediately above the sealing device.

11 Claims, 4 Drawing Sheets

SCREW PUMP

TECHNICAL FIELD

The present invention relates to a screw pump of the type comprising a screw rotatably arranged in a housing the threads of which screw are partially in engagement with a rotatable sealing device comprising radial sealing discs, whereby the screw area of the screw, including thread grooves and thread walls, are formed by a generatrix which is a part of a circle arc, the circle of which is rotatable around an eccentric rotation axis when the generatrix rotates around the axis of the screw and is displaced along this with a velocity being proportional to the rotational velocity of the screw and wherein the sealing device comprises at least one circular disc the eccentric rotational axis of which, which is arranged transverse to the axis of the screw coincides with the rotation axis of the generatrix, i.e., the rotation axis of the disc is a tangent to the generatrix.

The object of the present invention is to obtain a screw pump of the above type which is very compact and which allows being introduced into so called "butterworth" spaces in tankers, i.e., such having a diameter of 300 mm, but having an improved pumping capacity.

Another object is to obtain a screw pump of the said type by mews of which pumping can be carried out from a very close distance from e.g., a tank bottom, such as at the cleansing of oil tanks onboard ships, or collecting sites for spill oil at harbours.

BACKGROUND OF THE INVENTION

Industrial rest products, such as chemical waste, spill oil crude oil and others, quite often have a very high viscosity, in particular at ambient temperatures of 0–25° C. or lower as well as they are heavily polluting with wearing particles of varying sizes, in particular after discharge in natural soil. At the pumping of such products it is thus important to use such a low speed pump as possible which can accept and transport large particles as well as to provide the highly viscous product ample time to flow up to the pump.

Today, so called modified Archimedes screw pumps are used having a multiple-toothed radially positioned sealing and pressure build-up disc, which is in engagement with the screw. An example of such a screw pump is disclosed in SE-B-8101863. Because of the geometry of the sealing disc the meshing part of the screw can not be machined in a simple way, which implies bad sealing and high wear on the included parts. The displacement is limited by screw flanks during one screw turn and the cylinder wall and two successive teeth on the sealing disc. In practise the whole screw diameter cannot be used since the screw must have a supporting centre shaft, which steals a part of the displacement of the pump. Moreover the relatively large sealing disc demands large space which results in that the pump becomes bulky and cannot by made compact enough with regard to capacity for fitting into "butter-worth"-spaces.

It further known from EP-A-0 523 113 a screw pump of the type given in the preamble where the screw area of the screw, including thread grooves and thread walls, are formed by a generatrix which is a part of a circle arc, the circle of which is rotatable around an eccentric rotation axis when the generatrix rotates around the axis of the screw and is displaced along this with a velocity being proportional to the rotational velocity of the screw and wherein the sealing device comprises at least one circular disc the eccentric rotational axis of which, being arranged transverse to the axis of the screw coincides with the rotation axis of the generatrix. i.e., the rotation axis of the disc is a tangent to the generatrix.

This screw pump in a commercial embodiment, has at a pumping volume of 65 $m^3$/hr a length of 0.88 m and a largest diameter of 0.44 m. This pump has a screw being mounted in both ends and which comprises in total three thread turns. The commercial product is not capable of inter alia due to is mounting at its "lower" end to come close enough to a bottom surface and is thus not capable of sucking clean enough at a total emptying of a tank. Further, the pump can not work in the collecting spaces present.

The present object is now better understood with regard to what has been cited above and this object in accordance with above shall be completed with obtaining a pump which can work so close as possible to its suction surface in order to facilitate a maximum elimination of the pumped product. Simultaneously as the pump has this ability it shall still accept large particles in relation to its diameter.

DESCRIPTION OF THE PRESENT INVENTION

It has now surprisingly been shown possible to be able to solve the present problem and fulfill the object by means of the present invention which is characterized in that the screw is mounted in one end, and that the screw has a radially, partially extending broad flange without any rise in a cross-section immediately above the sealing device.

Further characteristics are evident from the accompanying claims.

By means of the present invention a very compact screw pump is achieved having with regard to its displacement a high capacity. A screw pump of the diameter 200 mn has a capacity of 70 ton of oil/br, when the effective screw length is less than 200 mm and at a diameter of 141 mm an effect of about 25 ton/hr is achieved.

By means of the present invention, further, a deepening of the screw area in axial direction is obtained in combination with the broad flange, into the screw body, whereby a thickness of the screw parts is obtained, with the exception of the central longitudinal axis part, which material thickness is essentially the same all over the screw.

Further, there is achieved using a preferred embodiment of the present invention, an overlap of the working Areas of the sealing discs amounting to at least 10°, whereby any internal leakage in the screw pump is markedly reduced.

By increasing the size of the diameter in the inlet part of the screw pump a markedly better feeding of the pumped material to the screw pump is obtained. This increase of size is obtained as an effect of the improved overlapping of the working areas of the sealing discs which in turn is obtained by an enlargement of the arc of the abutment lines of the sealing discs.

The present invention will be described more in detail in the following with reference to the accompanying drawing which shows a preferred embodiment of the present invention, however, without being restricted thereto. In the drawing FIG. 1 shows a first side view of an embodiment of the invention;

Figure 1:
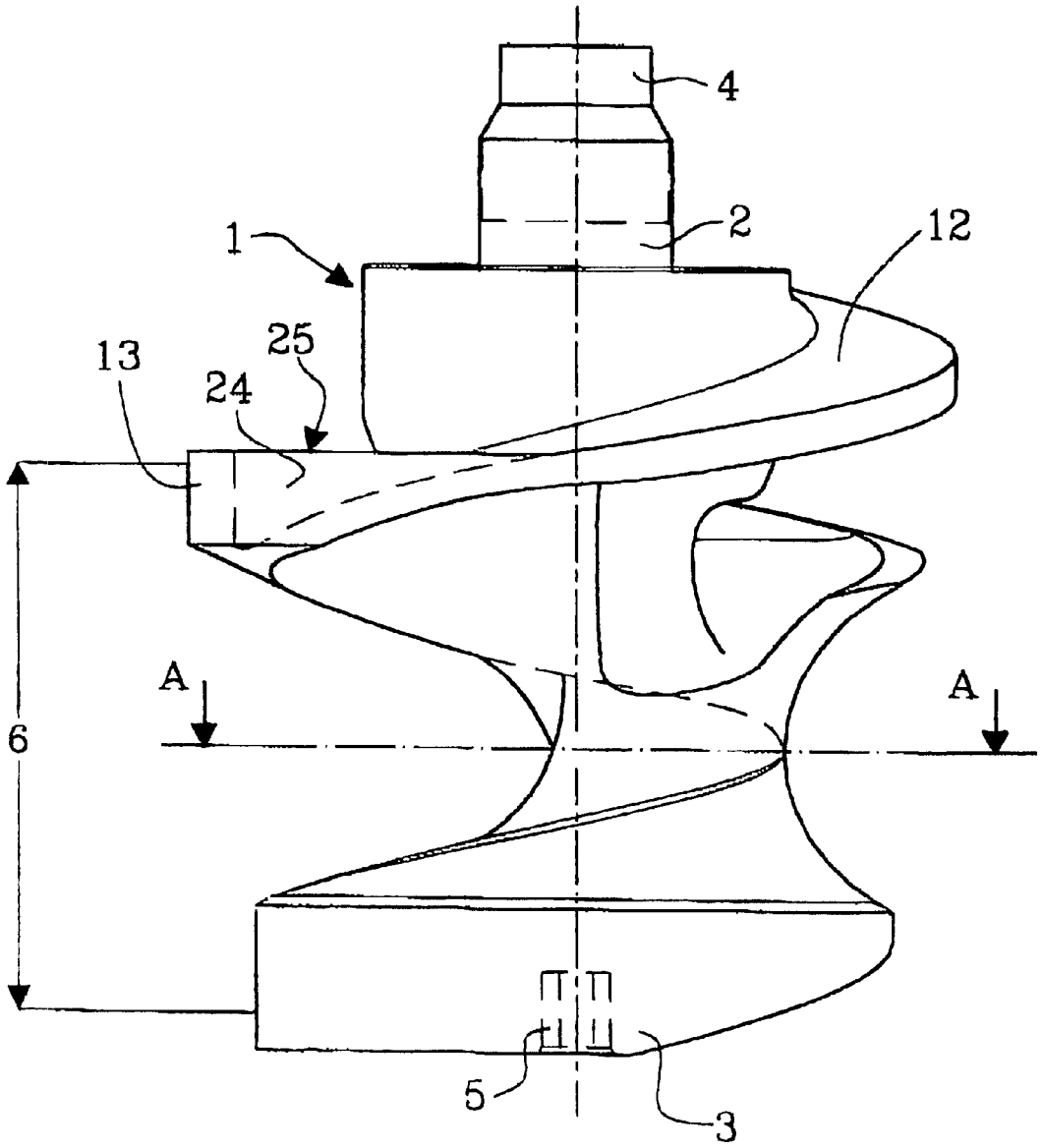
Figure 2:
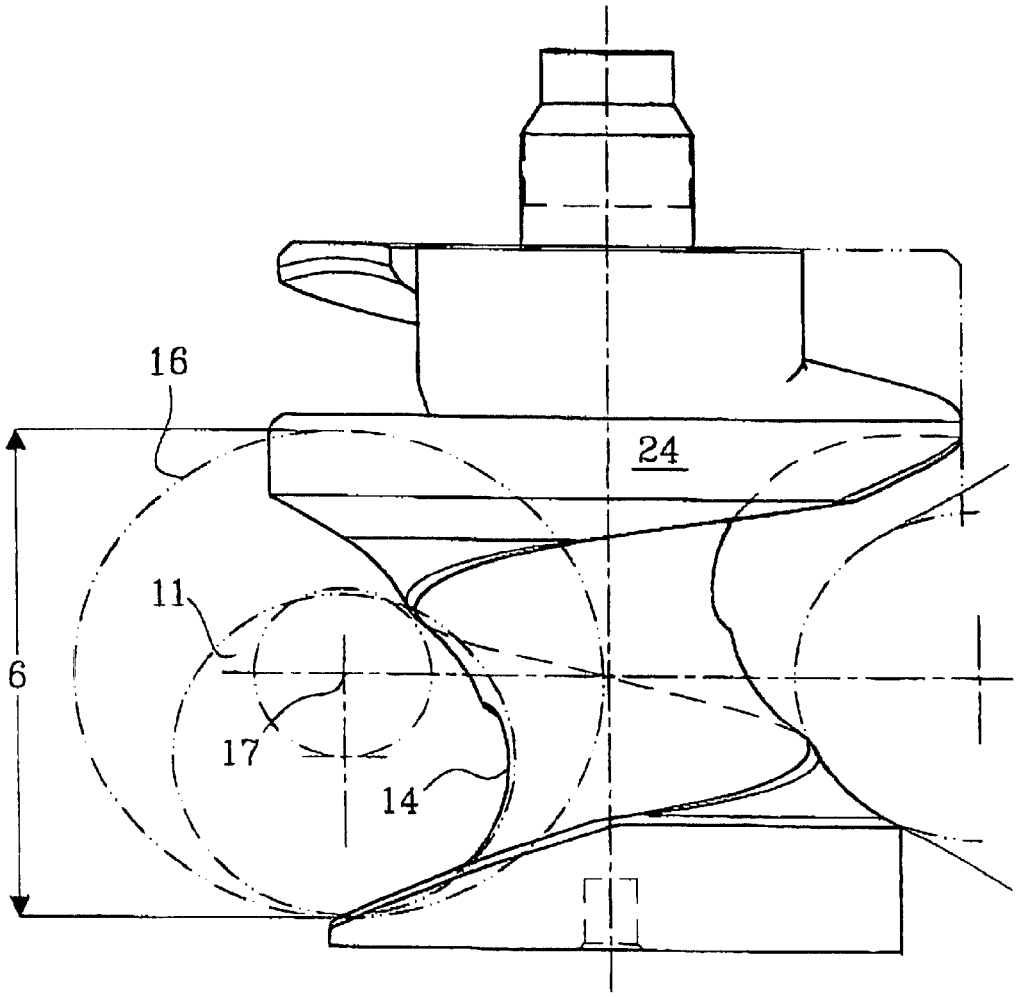
FIG. 2 shows a second side view of the embodiment according to FIG. 1 turned 90°.
Figure 3:
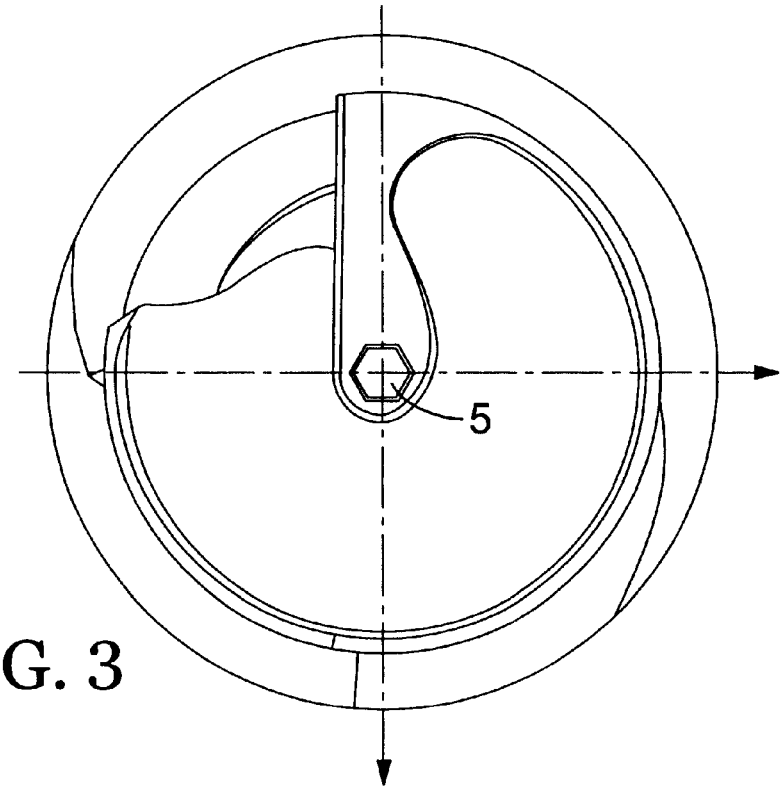
FIG. 3 shows the embodiment according to FIG. 1 seen from one short side.
Figure 4:
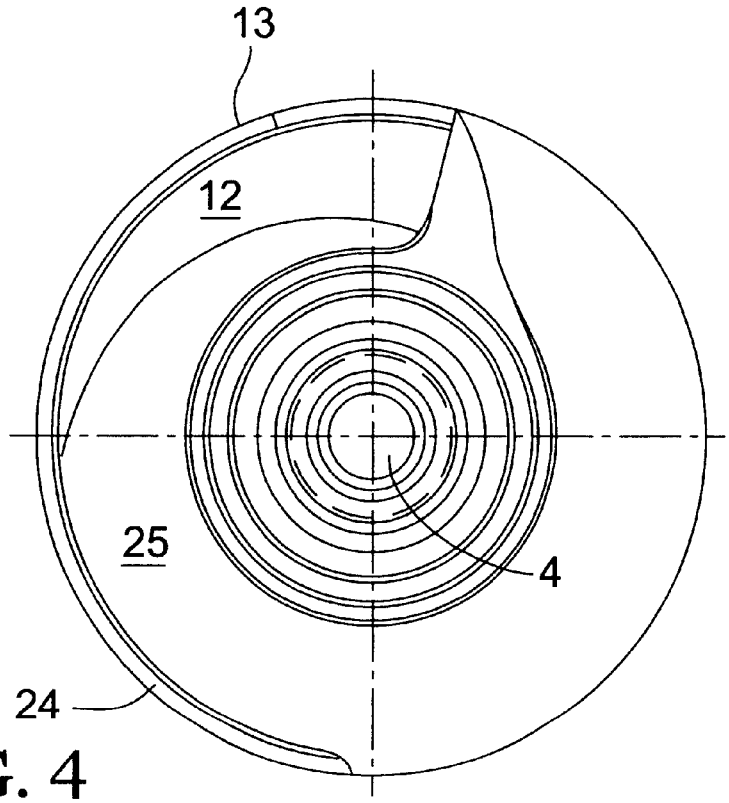
FIG. 4 shows the embodiment according to FIG. 1 seen from the other short side.
Figure 5:
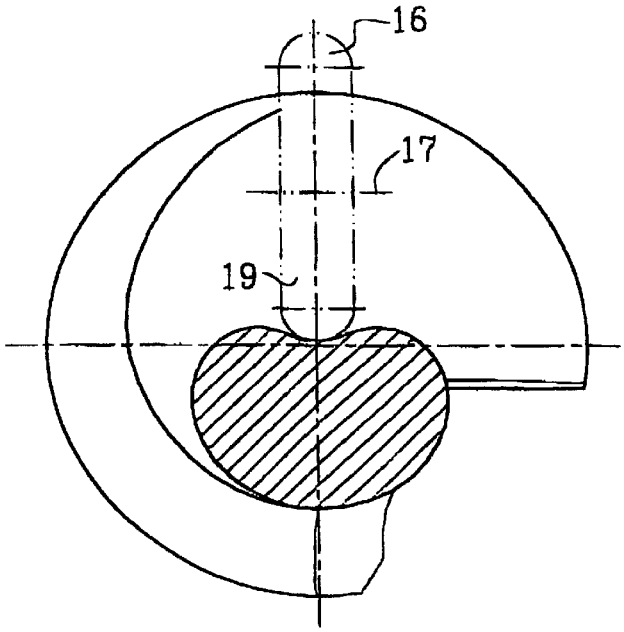
FIG. 5 shows a cross-section through the embodiment according to FIG. 1 in a plane perpendicular to the longitudinal axis of the screw along the line A—A of FIG. 1.
Figure 6:
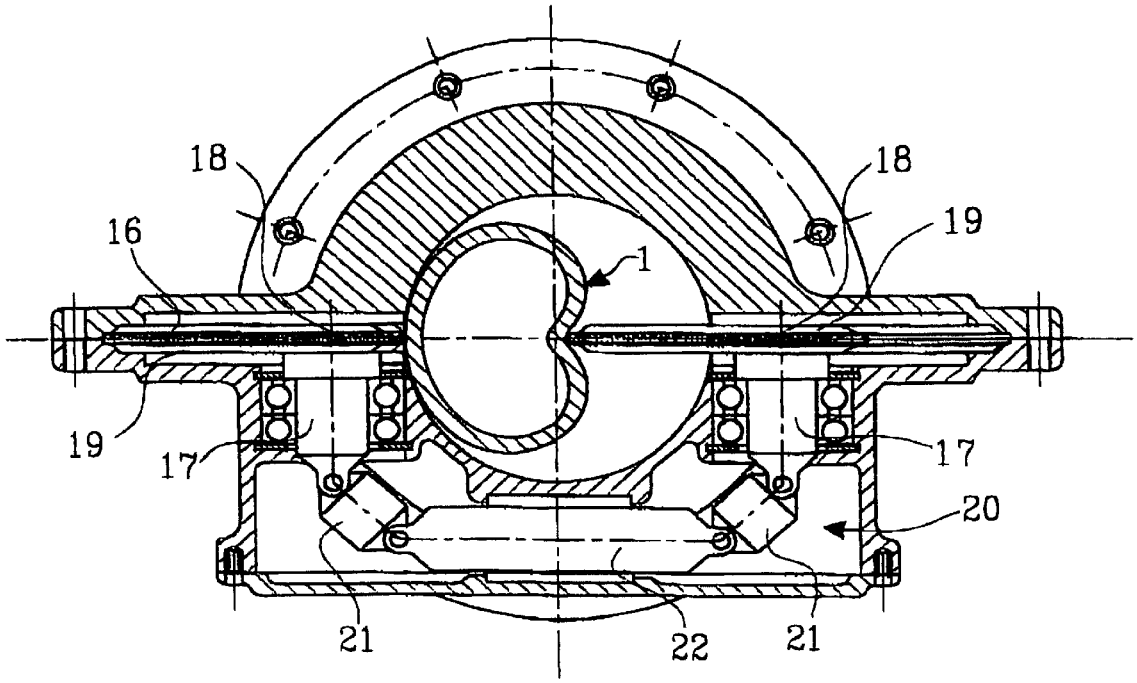
FIG. 6 shows a cross-section along the line A—A of FIG. 1 in a complete pump with its sealing discs.

1 denotes generally a screw of a screw pump, whereby the screw 1 comprises a driving end 2 and a free extending end 3. The driving end 2 comprises in the present embodiment a shaft tenon 4 for receiving, on the one hand, a driving shaft (not shown) from a motor (not shown), and, on the other hand, a force adopting bearing (not shown). The free extending end 3 comprises a sex edged hole 5 via which the screw can be rotated or handled in another way, as well as a second supporting bearing can be arranged if so required by the demands of the pump in which the screw 1 is a part. Hereby the capacity requirement and type of goods to be pumped as well as the degree of contaminants of solid material which may be present in the pumped goods.

The driving end 2 is the outlet section of the screw 1, as well, for the goods to be pumped when the screw is placed in a pump housing and the free extending end is the inlet section of the pumped goods. The outlet end has a greater diameter than the inlet end. Between these two parts, the inlet section and the outlet section, there is a compressing section 6 which comprises on the one hand a specially designed part of the screw, on the other hand a sealing device cooperating with this said pan.

The inlet end is arranged directly in connection with the bottom of the screw and without any bearing in order to achieve a so close pumping position as possible, such as at the emptying of oil tanks.

The compressing section 6 of the screw 1 is designed as a screw area in the form of a thread groove 12 and a thread wall 13 being generated by a generatrix being part of a circle arc 14 the circle of which is rotatable around an eccentric axis 17, when the generatrix rotates around the axis of the screw 1 and simultaneously is displaced along this with a velocity that is proportional to the rotational speed of the screw. The thread groove and the thread wall have, within the compressing section 6, obtained the shape as shown in the side views 1 and 2, i.e., the screw 1 has a deeply excavated part within that part of the screw where a working phase is at hand, while that pant of the screw 1 comprising a return phase is essentially the supporting cross-section of the screw.

The sealing device 11 at the compressing section 6 of the screw consists, in the embodiment shown, of two sealing discs 16 being rotatable around each their eccentrically arranged axis 17, which coincides with a geometric axis 18. Each sealing disc 16 is provided with a peripherally arranged sealing means 19. The sealing discs 16 are arranged radially relative to the screw 1 and are arranged opposite to each other, whereby the size of the discs and the position of the eccentric axis 17 is so chosen that the sealing disc 16 being in active in its one end position extends mainly up to the centre axis of the screw. The two axis 17 of the sealing discs 16 are connected to each other by means of a transmission 20 which, in the figures shown, consists of double cardan joints 21 joined to each other via a shaft 22. The sealing discs 16 obtain their rotation via the rotation of the screw 1.

The sealing discs 16 are displaced 180° in phase which means that there is only one sealing disc at a time that is in operational position. The sealing disc not being in operational position but only possesses sealing action is returned to starting position as it is connected via the transmission to the other disc, which at the time is active, until it comes up to a position for starting a working, cycle. The working cycle is thus utilized twice per revolution.

In order to prevent an inner leakage between the screw 1 and the sealing disc 16 on the side where it is situated at working phase, the cylindrical thread tops of the screw been designed with an axial extension which is so large that it during the whole working phase seals the space in which the sealing disc is displaceable.

The present screw 1 has a radially, partially extending broad flange 24 without any rise in a cross-section immediately above the sealing device.

The present screw 1 further has a deepening 25 in combination with the broad flange 24 of the screw area in an axial direction into the screw body, whereby a material thickness of the pans of the screw, with the exception of the central longitudinal shaft part, which material thickness is essentially the same all over the screw 1.

The screw 1 is further, so designed with its thread groove and thread wall that an overlapping of the working areas of the sealing discs with at least 10° is achieved whereby internal leakage within the screw pump is markedly reduced.

By increasing the diameter of the screw 1 at the inlet part 2 a markedly improved feeding of the pumped material to the screw pump is obtained. This increase is obtained as an effect of the improved overlapping of the working areas of the sealing discs, which in turn is obtained by arc enlargement of the abutment lines of the sealing discs.

What is claimed is:

1. Screw pump of the type comprising a screw (1) rotatably arranged in a housing the threads of which screw are partially in engagement with a rotatable seating device (11) comprising radial sealing discs (16), whereby the screw area of the screw, including thread grooves and thread walls, are formed by a generatrix which is a part of a circle arc, the circle of which is rotatable around an eccentric rotation axis when the generatrix rotates around the axis of the screw and is displaced along this with a velocity being proportional to the rotational velocity of the screw and wherein the sealing device comprises at least one circular disc the eccentric rotational axis of which, which is arranged transverse to the axis of the screw coincides with the rotation axis of the generatrix, the rotation axis of the disc is a tangent to the generatrix, characterized in that the screw (1) is mounted in one end (2), and that the screw has a radially, partially extending broad flange (24) without any rise in a cross-section immediately above the sealing device (11).

2. Screw pump according to claim 1, characterized in, that the screw (1) in combination with the broad flange (24) has a deepening of the screw surface in an axial direction into the screw body, whereby it is achieved a material thickness in the parts of the screw, with the exception of the particular central longitudinal shaft part, which material thickness is substantially the same all over the screw.

3. Screw pump according to claim 2, characterized in, that the screw (1) has an overlapping of the working areas of the sealing discs (16) of at least 10°, whereby any internal leakage of the screw pump is markedly reduced.

4. Screw pump according to claim 3, characterized in, that the screw (1) has a size increase of the diameter of the inlet part (2) which increase of diameter is obtained by increasing the arc circle of the abutment lines of the sealing discs (16).

5. Screw pump according to claim 1, characterized in, that the screw (1) has an overlapping of the working areas of the sealing discs (16) of at least 10°, whereby any internal leakage of the screw pump is markedly reduced.

6. Screw pump according to claim 5, characterized in, that the screw (1) has a size increase of the diameter of the inlet part (2) which increase of diameter is obtained by increasing the arc circle of the abutment lines of the sealing discs (16).

7. Screw pump according to claim 1 where the screw has an outlet end and an inlet end, and where the threads of the screw have a major diameter where the major diameter of the thread of the screw adjacent to the broad flange is greater than the major diameter of the threads closer to the inlet end.

8. Screw pump according to claim 1, wherein the broad flange and a surface of the screw adjacent the broad flange together define a deepening that extends in an axial direction and in a circumferential direction.

9. Screw pump according to claim 8, wherein a depth of the deepening generally increases in a radial direction from the axis to the broad flange.

10. Screw pump according to claim 1 where the screw pump has an outlet end and the broad flange extends from the thread grooves towards the outlet end of the screw pump.

11. Screw pump according to claim 10 where the broad flange has an upper surface extending in a plane substantially perpendicular to the axis of the screw, the upper surface having a width in the radial direction that defines an arc which extends partially around the screw.

* * * * *

UNITED STATES PATENT AND TRADEMARK OFFICE

CERTIFICATE OF CORRECTION

PATENT NO. : 6,447,275 B1
DATED : September 10, 2002
INVENTOR(S) : Anders Johansson It is certified that error appears in the above-identified patent and that said Letters Patent is hereby corrected as shown below:

Column 1,
Line 24, “mews” should read -- means --.
Line 66, “generatrix.” should read -- generatrix, --.

Column 3,
Line 18, after “end” add -- 3 --.
Line 24, “pan” should read -- part --.
Line 40, “pant” should read -- part --.
Line 66, “working, cycle” should read -- working cycle --.

Column 4,
Line 13, “pans” should read -- part --.

Signed and Sealed this

Sixteenth Day of November, 2004

JON W. DUDAS
*Director of the United States Patent and Trademark Office*